US005413436A

United States Patent [19]

Merz

[11] Patent Number: 5,413,436

[45] Date of Patent: May 9, 1995

[54] SUPPORT COLUMN

[75] Inventor: Volker Merz, Iserlohn, Germany

[73] Assignee: MBK-Hydraulik Meuwsen & Brockhausen GmbH, Kamp-Lintfort, Germany

[21] Appl. No.: 157,682

[22] Filed: Nov. 24, 1993

[30] Foreign Application Priority Data

May 17, 1993 [DE] Germany ..... 43 16 390.4

[51] Int. Cl.[6] ..... E21D 15/14

[52] U.S. Cl. ..... 405/290; 405/272; 248/354.2

[58] Field of Search ..... 248/354.2; 405/272, 405/288, 290

[56] References Cited

U.S. PATENT DOCUMENTS

| | | | |
|---|---|---|---|
| 881,609 | 3/1908 | Nellen et al. | 248/354.2 |
| 1,765,200 | 6/1930 | Bullough . | |
| 4,255,071 | 3/1981 | Koppers et al. | 405/290 |
| 4,332,512 | 6/1982 | Heinz mann et al. | 405/290 |
| 5,165,824 | 11/1992 | Corcoran et al. | 248/354.2 X |
| 5,273,378 | 12/1993 | Merz et al. | 405/290 |

FOREIGN PATENT DOCUMENTS

| | | | |
|---|---|---|---|
| 2847906 | 5/1979 | Germany . | |
| 2941663 | 5/1980 | Germany . | |
| 3915837 | 11/1990 | Germany . | |
| 580133 | 7/1958 | Italy | 248/354.2 |
| 365556 | 1/1932 | United Kingdom | 248/354.2 |
| 2070666 | 9/1981 | United Kingdom | 405/290 |
| 2078822 | 1/1982 | United Kingdom | 405/290 |
| 2114183 | 8/1983 | United Kingdom | 405/290 |

*Primary Examiner*—Randolph A. Reese
*Assistant Examiner*—John A. Ricci
*Attorney, Agent, or Firm*—Friedrich Kueffner

[57] ABSTRACT

A support column for underground mining has a hollow lower column component and a hollow upper column component. The upper column component is slidingly mounted in the lower column component. The bottom of the upper column component is a plate member. The circumferential outer surface of the plate member and the inner surface of the lower column component form an annular gap through which air and water can penetrate, while a non-hardening filler introduced into the interior space of the lower column component through a filling unit cannot penetrate through the gap. The filler accumulating in the interior space of the lower column component causes the upper column component to be moved relative to the lower column component and the support column is clamped between the abutments. The support column can be removed by discharging filler through an outlet opening in the lower column component.

12 Claims, 1 Drawing Sheet

SUPPORT COLUMN

BACKGROUND OF THE INVENTION

1. Field of the Invention

The present invention relates to a support column for underground longwalls, roads, galleries or tunnels. The support column includes two telescoping hollow column components which are guided against each other. The lower of the column components can be filled with a non-hardening filler and is provided with a closable outlet opening.

2. Description of the Related Art

Support columns which can be filled with a hardening filler are known in the art. Prior to filling, these support columns are clamped or propped against the hanging wall and the foot wall or against the roof and the floor. In this connection, it is known from DE 28 47 906 to provide an auxiliary stay which remains in the column until the filler has hardened. DE 29 41 663 proposes the use of a clamping securing means in the form of a section ring with a cutting edge. In accordance with DE 39 15 837, the support column is clamped by means of a winding mechanism which is arranged in the support column. DE 41 15 209, which corresponds to U.S. patent application Ser. No. 07/934,660, now U.S. Pat. No. 5,273,378, describes a ring-shaped spring element as a clamping means.

All the above-described clamping means have in common that the support column is first clamped and the filler is filled in subsequently. After the filler has been filled into the support columns, the auxiliary means used for clamping lose their function. In addition, the above-described support columns have in common that they cannot be removed after clamping or placing. Accordingly, an economical utilization of material is possible only to a limited extent when such support columns are used.

U.S. Pat. No. 1,765,200 discloses a support column which includes two telescoping hollow column components which are guided against each other, wherein a non-hardening filler can be filled into the lower column component and the lower column component is provided with a closable outlet opening. The filler may be stone dust, sand or another suitable granulated material having a small grain size. The filler can be introduced into the column component by removing a base plate of the lower column component. The filler may also be introduced through a suitable opening in the base plate or in the wall of the lower column component. This opening is closed by a suitable closing member. Alternatively, the filler can also be introduced into the lower column component by removing the upper column component.

The bottom of the upper column component has a cutout which may have various configurations. Above the cutout, the interior space of the lower column component is in permanent connection with the interior space of the upper column component. The fact that the two interior spaces are connected results in the disadvantage that the support column cannot be clamped with a certain setting load. In addition, this support column has a resilient behavior because, when forces act in longitudinal direction of the support column, the filler can penetrate from the interior space of the lower column component through the cutout in the bottom of the upper column component into the interior space of the upper column component. Moreover, excess filler can be discharged out of the interior space of the upper column component through an opening in a cover plate of the upper column component.

SUMMARY OF THE INVENTION

Therefore, it is the primary object of the present invention to provide a support column of the above-described type which can be filled with a non-hardening filler, which can be placed actively and which still makes it possible to remove the support column.

In accordance with the present invention, the interior space of the upper column component is closed off relative to the interior space of the lower column component so as to be impermeable to filler material, so that, when the non-hardening filler is filled into the lower column component through a filling unit arranged in the lower column component, both column components are actively clampable against upper and lower abutments, and, after clamping, the upper column component is secured against sliding into the lower column component by the filler introduced into the lower column component, wherein an annular gap is provided between the outer surface of the upper column component and the inner surface of the lower column component, and wherein the annular gap is permeable to air and water but impermeable to filler.

Accordingly, the present invention provides that the interior space of the upper column component and the interior space of the lower column component are positively closed off relative to each other, so that it can be excluded with absolute certainty that filler penetrates from the interior space of the lower column component into the interior space of the upper column component. This results in the advantageous property of the support column that, when a non-hardening filler, such as, sand, comparable granulated materials or residual materials, is filled into the lower column component, the support column can be actively clamped relative to the upper and lower abutments, i.e., hanging wall and foot wall or roof and floor, and support forces can be developed immediately. The support column does not yield even when great loads act on the support column in longitudinal direction. The filler introduced into the interior space of the lower column component prevents insertion of the upper column component into the lower column component. Since the fillers used in this connection are usually introduced into the lower column component with air and/or water, the present invention further provides that these auxiliary agents can escape when a load is submitted to the support column. For this purpose, an annular gap is provided between the outer surface of the upper column component and the inner surface of the lower column component, wherein the annular gap is permeable to air and water but impermeable to filler. The support column according to the present invention can be easily removed by discharging filler as required through a closable discharge opening provided in the lower column component.

Since the support column according to the present invention is composed of only a few simple structural components, the support column can be manufactured very inexpensively. In addition, the support column can be used repeatedly.

In accordance with a preferred feature of the present invention, the interior space of the upper column component is separated from the interior space of the lower column component by means of a plate which forms the bottom of the upper column component, wherein the circumferential surface of the plate and the inner surface of the lower column component form the annular gap through which air and water can escape and through which filler cannot penetrate.

Although it is conceivable that the lower column component may be provided with a filling valve as well as with a discharge valve for the filler, it may be useful to construct the filling unit to be simultaneously a filling and discharge valve.

In order to prevent destruction of the support column according to the present invention in special cases, the upper column component may be provided with an intended yielding section which acts in axial direction of the support column. This intended yielding section may be the upper column component proper, either by constructing the upper column component of an appropriate material, or by providing the upper column component with a section extending in axial direction which is subjected to an intended plastic deformations when the rock pressure applies a certain load on the support column.

In accordance with another feature, the discharge opening provided in the lower column component for removing the filler and to make it possible to remove the support column, may be provided with a flap or a slide.

Another feature of the present invention provides that the upper end of the lower column component is provided with a securing means for transporting the column which interacts with the upper column component. This securing means makes it possible to slide the upper column component essentially completely into the lower column component and to lock the components in this telescoped position, so that this position is maintained during the transportation of the support column.

In accordance with another feature, securing means against sliding are provided at the end faces of the upper and lower column components. These securing means may be spike-like members which project from the end faces of the upper and lower column components.

The various features of novelty which characterize the invention are pointed out with particularity in the claims annexed to and forming a part of the disclosure. For a better understanding of the invention, its operating advantages, specific objects attained by its use, reference should be had to the drawing and descriptive manner in which there are illustrated and described preferred embodiments of the invention.

DETAILED DESCRIPTION OF THE PREFERRED EMBODIMENTS

Figure 1:
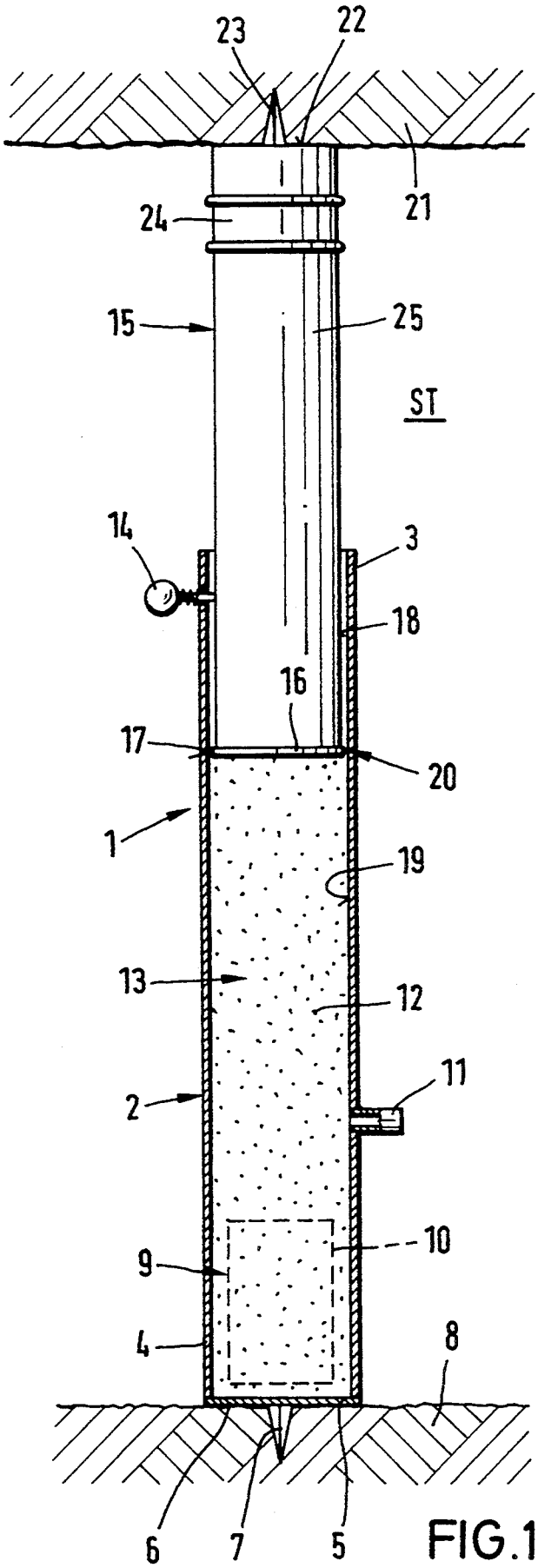
FIG. 1 is a schematic vertical sectional view of a support column for underground mining.
Figure 2:
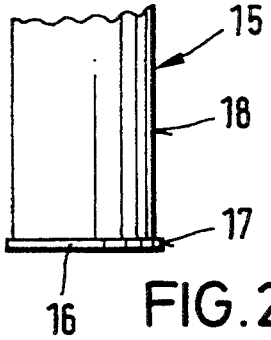
FIG. 2 is a partial sectional view showing the lower end of the upper column component of the support column of FIG. 1.

FIG. 1 of the drawing shows a support column 1 according to the present invention. The support column 1 is used in underground longwalls, roads, galleries or tunnels for keeping open a previously produced free cross section. In the following, the support column 1 is explained in detail as it is used in a gallery or tunnel ST.

The support column 1 has a lower column component 2 which is composed of a tube section. The column component 2 is open at the upper end 3 thereof and is closed at the lower end 4 by a base plate 5. The end face 6 of the base plate 5 which comes into contact with the floor 8 of the tunnel ST is provided with a spike 7 for protecting against slippage.

In addition, a closable discharge opening 9 is provided at the lower end 4 of the lower column component 2. The discharge opening 9 is equipped with a flap 10 or a slide member.

A filling unit 11 in the form of a filling valve is arranged approximately in the middle of the lower column component 2 at a location which is easily accessible to a miner. Sand 12 mixed with water can be introduced through the filling unit 11 into the interior space 13 of the lower column component 2.

A securing means 14 for securing the support column 1 during transport is provided at the upper end 3 of the lower column component 2.

An upper column component 15 which is also formed by a tube section extends into the lower column component 2. The upper column component 15 has a plate-shaped bottom 16 which is closed over the entire area thereof. A circumferential surface 17 projects radially beyond the outer surface 18 of the upper column component 15.

The surface 17 of the bottom 16 and the inner surface 19 of the lower column component 2 form an annular gap 20 which has a width which prevents the penetration of sand 12 therethrough, while permitting the flow of air and water therethrough.

Another spike 23 for securing against slippage relative to the roof 21 is mounted on the end face 22 of the upper column component 15 which contacts the roof 21.

A yielding section 24 which acts in axial direction of the support column 1 is provided in the upper column component 15 at a distance below the end face 22.

During transportation of the support column 1, the upper column component 15 is inserted into the lower column component 2 essentially over the entire length thereof. The securing means 14 ensures that this inserted position is maintained even when sudden loads act on the support column 1.

At the location of use, the securing means 14 is released and sand 12 mixed with an auxiliary agent in the form of water is filled through the filling unit 11 into the interior space 13 of the lower column component 2. Because of the introduction of sand, and because the surface area of the bottom 16 of the upper column component 15 is closed, the upper column component 15 is pushed upwardly in the lower column component 2, so that the end faces 6 and 22 of the lower column component 2 and the upper column component 15, respectively, are pressed against the floor 8 and the roof 21. As a result, the spikes 7 and 23 are forced into the floor 8 and the roof 21, respectively. As the sand 12 mixed with water is introduced into the lower column component 2, water and air can escape through the annular gap 20 formed between the circumferential surface 17 of the bottom 16 and the inner surface 19 of the lower column component 2.

The closed bottom 16 ensures that no sand 12 can penetrate from the interior space 13 of the lower column component 2 into the interior space 25 of the upper column component 15.

During the active clamping of the support column 1 between the floor 8 and the roof 21, the support column 1 immediately produces a supporting force. Subsequently, the supply of additional sand 12 through the filling unit 11 is interrupted. When the support column 1 is to be removed, it is merely necessary to open the flap 10 or the slide member at the lower end 4 of the lower column component 2, so that sand 12 is discharged out of the lower column component 2 and the clamping action of the support column 1 between the floor 8 and the roof 21 is canceled.

The invention is not limited by the embodiments described above which are presented as examples only but can be modified in various ways within the scope of protection defined by the appended patent claims.

I claim:

1. A support column for underground mining to be clamped between an upper abutment and a lower abutment, the support column comprising an upper hollow column component and a lower hollow column component, the upper column component being telescopingly mounted in the lower column component, the upper and lower column components each having an interior space, means for completely closing off the interior space of the upper column component relative to the interior space of the lower column component, the lower column component comprising a filling unit for filling a non-hardening filler mixed with an auxiliary agent into the lower column component, an annular gap being defined between an outer surface of the upper column component and an inner surface of the lower column component, the gap having a width, the width being selected such that the auxiliary agent and air can pass through the gap and filler is prevented from passing through the gap, whereby filler accumulating in the interior space of the lower column component causes the upper column component to slide relative to the lower column component in an outward direction and finally clamps the support column between the upper and lower abutments.

2. The support column according to claim 1, wherein the filler is sand.

3. The support column according to claim 1, wherein the auxiliary agent is water.

4. The support column according to claim 1, wherein the means for closing off the upper column component relative to the lower column component is a bottom of the upper column component formed by a plate member, the plate member having an outer circumferential surface, wherein the outer circumferential surface and the inner surface of the lower column component form the annular gap.

5. The support column according to claim 1, wherein the filling unit comprises a combined filling and discharge valve.

6. The support column according to claim 1, wherein the upper column component comprises an intended yielding section acting in axial direction of the support column.

7. The support column according to claim 1, wherein the lower column component has a lower end, the lower column component having a discharge opening at the lower end, further comprising one of a flap and a slide member for opening and closing the discharge opening.

8. The support column according to claim 1, wherein the lower column component has an upper end, a securing means being mounted on the upper end of the lower column component for preventing relative movement between the upper column component and the lower column component during transportation of the support column.

9. The support column according to claim 1, wherein the upper and lower column components each have an end face facing the abutments, securing means being mounted on the end faces for preventing slippage of the upper and lower column components relative to the abutments.

10. A method of clamping a support column for underground mining between an upper and a lower abutment, the support column including an upper hollow column component and a lower hollow column component, the upper column component being telescopingly mounted in the lower column component, the upper and lower column components each having an interior space, means for completely closing off the interior space of the upper column component relative to the interior space of the lower column component, the lower column component comprising a filling unit for filling a non-hardening filler mixed with an auxiliary agent into the lower column component, an annular gap being defined between an outer surface of the upper column component and an inner surface of the lower column component, the gap having a width, the width being selected that the auxiliary agent and air can pass through the gap and filler is prevented from passing through the gap, whereby the method comprising filling thee filler mixed with the auxiliary agent into the interior space of the lower column component so that the filler accumulates in the interior space of the lower column component and the auxiliary agent and air escape through the annular gap until the filler presses the upper and lower column components against the abutments.

11. The method according to claim 10, wherein the filler is sand.

12. The method according to claim 10, wherein the auxiliary agent is water.

* * * * *